US012642346B2

(12) United States Patent
Emale

(10) Patent No.: US 12,642,346 B2
(45) Date of Patent: Jun. 2, 2026

(54) COSMETICS PROTECTION APPARATUS FOR BATHING AND DRESSING

(71) Applicant: JoAnn Emale, Dallas, TX (US)

(72) Inventor: JoAnn Emale, Dallas, TX (US)

( * ) Notice: Subject to any disclaimer, the term of this patent is extended or adjusted under 35 U.S.C. 154(b) by 468 days.

(21) Appl. No.: 18/169,433

(22) Filed: Feb. 15, 2023

(65) Prior Publication Data

US 2023/0189965 A1 Jun. 22, 2023

Related U.S. Application Data

(63) Continuation-in-part of application No. 16/205,234, filed on Nov. 30, 2018, now abandoned.

(51) Int. Cl.
*A45D 44/12* (2006.01)

(52) U.S. Cl.
CPC ..... *A45D 44/12* (2013.01)

(58) Field of Classification Search
CPC ..... A45D 44/12; A61F 9/029; A41D 13/1161; A41D 13/1107; A41D 13/1184; A41D 31/102
See application file for complete search history.

(56) References Cited

U.S. PATENT DOCUMENTS

| | | | | |
|---|---|---|---|---|
| 2,191,325 | A * | 2/1940 | Skillen | A45D 44/12 2/206 |
| 8,833,311 | B2 * | 9/2014 | Kostelec | A01K 13/006 54/80.1 |
| 10,687,569 | B1 * | 6/2020 | McDirmid | A42B 3/20 |
| 2011/0061151 | A1 * | 3/2011 | Chang | A41D 13/11 2/9 |
| 2015/0223530 | A1 * | 8/2015 | Grieco | A41D 20/00 2/209.3 |
| 2017/0258151 | A1 * | 9/2017 | Roberts | A41D 13/1161 |
| 2018/0213918 | A1 * | 8/2018 | Graves | A45D 44/12 |

* cited by examiner

*Primary Examiner* — Khoa D Huynh
*Assistant Examiner* — Erick I Lopez
(74) *Attorney, Agent, or Firm* — Kearney, McWilliams & Davis, PLLC; William Yarbrough

(57) ABSTRACT

A device and method for preserving the state of facial cosmetics during bathing and dressing is disclosed. The invention being comprised of a partial head wrap with drawstring and flexible, waterproof substrate. A lower portion of said substrate having a mesh material for breathing comfort. Objects of the invention include preventing water from making contact with and chemically removing facial makeup as well as preventing clothing from making contact with and mechanically removing facial makeup.

12 Claims, 3 Drawing Sheets

COSMETICS PROTECTION APPARATUS FOR BATHING AND DRESSING

CROSS-REFERENCE TO RELATED APPLICATIONS

U.S. patent application Ser. No. 16/205,234 filed Nov. 30, 2018

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention generally relates to cosmetics. More specifically, it relates to a method for preserving facial cosmetics during showering and dressing.

BACKGROUND

Many who use facial cosmetics and hair enhancements, particularly those in the modeling and entertainment industries, often encounter situations that require quick changes of clothing and the need to shower without having to perform reapplications of makeup and hair. Exposure to warm water during a shower as well as tight articles of clothing during donning and dotting can strip makeup (such as lipstick and eyeliner) from the face and rearrange a person's hair into an unacceptable style.

Often times consumers need to try on articles of clothing (such as shirts and blouses) first before making a purchase without damaging them with traces of makeup and hair products on collars and neck lines. In addition, the popularity of hair extensions has become exponential over the last few years and users need a means to protect them from shifting or being pulled out during showering. Over the years, several inventors have made attempts to mitigate these issues through the introduction of protective hoods. U.S. Pat. Nos. D635,295S1 and 4,887,316A granted to Oswalt et. al. and Morandini respectively disclosed makeup protectors comprised of hoods that encompasses the entire head unlike the present disclosure that teaches embodiments that cover certain portions of the head. U.S. Pat. No. 4,722,100A granted to Greer disclosed a makeup and clothing protector that encompasses a user's entire head rather than portions of the head like the current disclosure teaches. U.S. Patent No. 20090083893A1 granted to Bergman & Guidi disclosed a hair and makeup protector that also encompasses a user's entire head unlike the present disclosure teaches. US20010037518A1 granted to Whitfield disclosed a hood-type makeup protector but it does not include drawstrings as the current disclosure teaches. As the cosmetics and hair industries continue to advance their product lines with the incorporation of new nano particles as well as more traditional organic ingredients, the need to preserve their applications as well as articles of clothing has become increasingly apparent.

SUMMARY OF THE INVENTION

The device herein disclosed and described provides a solution to the shortcomings in the prior art through the disclosure of a method for preserving makeup (such as lipstick, mascara, eye shadow, foundation, rouge and lotions) during bathing and dressing. An object of the invention is to prolong the life of makeup beautifications.

Another object of this invention is to provide a means to prevent water under pressure (such as water coming from a shower head during bathing) and splashes to come in contact with facial makeup. The invention includes a perimeter drawstring that fastens the apparatus on the frontal portion of the head redirecting water flow around and away from the face.

Another object of the invention is to provide a means to prevent articles of clothing (such as shirts and blouses) from coming in contact with makeup. The aforementioned drawstring also anchors the apparatus tightly to the head to prevent dislocation. This embodiment maintains a constant state of protection while a user pulls tight articles of clothing with tight, form-fitting neck lines over their head. It can also maintain its position and protection when a user pulls said tight-fitting clothing off.

Another object of the invention is to preserve users' vision while wearing the apparatus. A majority of the substrate is comprised of a finely-woven material that allows for translucency as well as water proofing allowing a user, to bath safely.

Another object of the invention is to maintain user comfort during use. A small mesh area is configured at the bottom of the apparatus allowing a user to breathe easy.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from tie spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF THE FIGURES

The accompanying drawings, which are incorporated herein and form a part of the specification, illustrate some, but not the only or exclusive, examples of embodiments and/or features.

Figure 1:
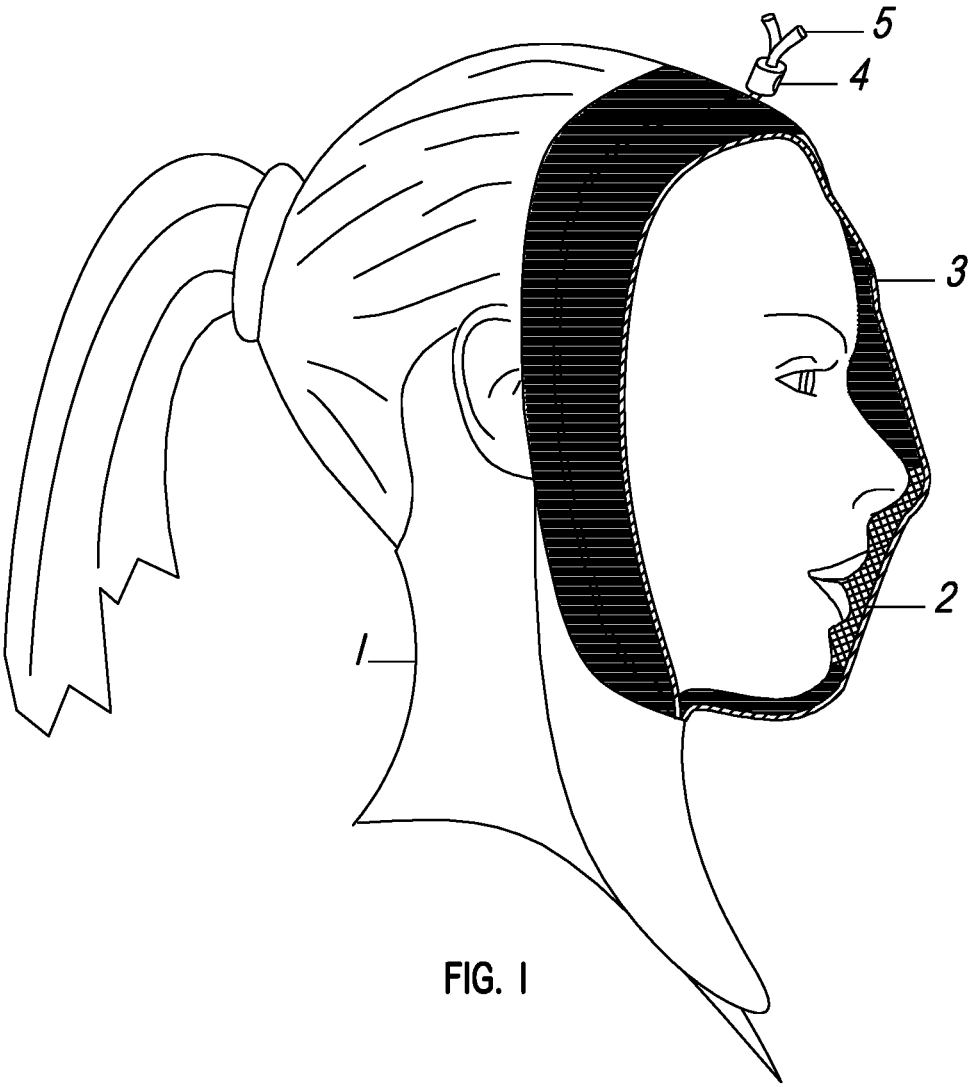
FIG. 1 showing a partial sectional view of the invention on a user.

Other aspects of the present invention shall be more readily understood when considered in conjunction with the accompanying drawings, and the following detailed description, neither of which should be considered limiting.

DETAILED DESCRIPTION OF FIGURES

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 2:
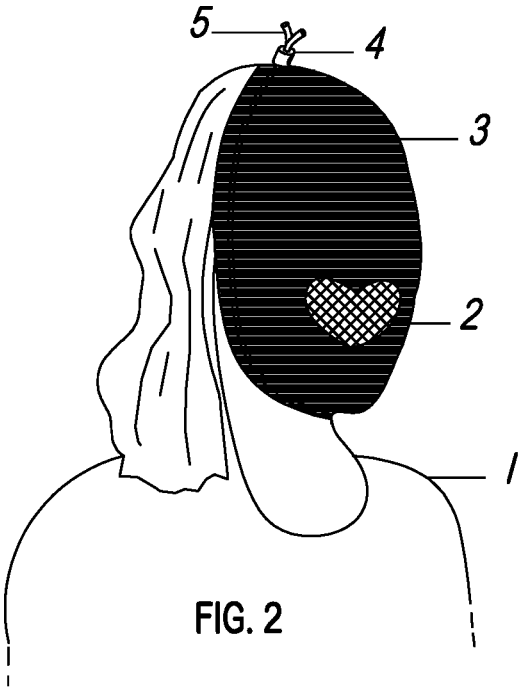
FIG. 2 showing a side perspective view of the invention on a user.
Figure 3:
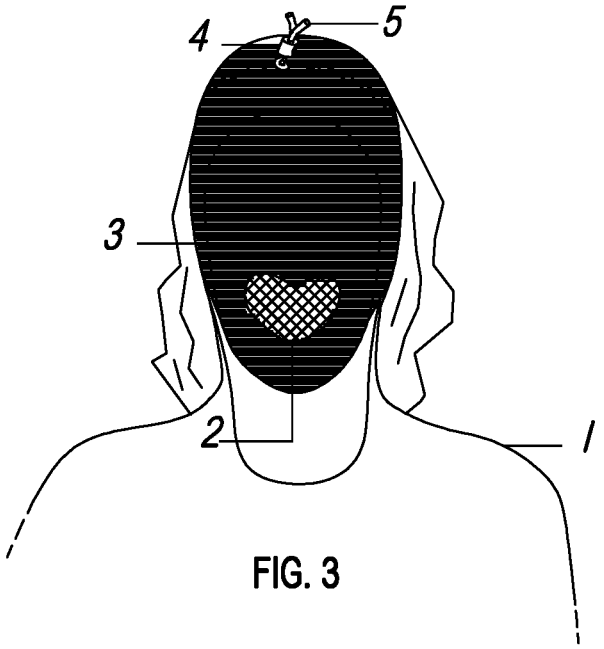
FIG. 3 showing a front perspective view of the invention on a user.

FIG. 1 showing a partial perspective view of the apparatus on user comprised of a waterproof apparatus shell 3 being made of a lightweight, translucent waterproof material such as, but not limited to, Gortex™, Nylon, etc. and having a concave shape configured to receive a user's face of the user 1. The figure also showing the invention having a superiorly drawn drawstring 5 wherein said drawstrings is sewn into a perimeter of the apparatus and being made of a flexible, strand material such as, but not limited to nylon, rubber and the like. The apparatus having a spring-loaded, push-button cylinder lock 4 disposed superiorly to receive each end of said drawstring 5 therein allowing a user to adjust the tension and creating a seal thereabout face 1. Other varieties of drawstring fasteners can include, but not be limited to Velcro™ tabs, wire crimps and the like. FIGS. 2 and 3 showing a front perspective view of the embodiment of the invention having a mesh panel 2 on a lower third of apparatus, and lower third being opposite of said spring-loaded, push-button cylinder lock 4, being made of a slightly rigid, net-like material such as metal or plastic wire and the like letting air pass through such as but not limited to layers of polyester, silk etc.

The apparatus shell 3 is adjustable both superiorly and inferiorly. Adjustment superiorly, via said spring-loaded, push-button cylinder lock, is accomplished by loosening and tightening the drawstring to lessen or increase adherence about and to the face of user 1. Moreover, the placement of the superior spring-loaded, push-button cylinder lock 4 and drawstring about the upper perimeter of the apparatus is adjustable to fit to the user's forehead, past the user's hairline and areas between user's forehead and hairline as to avoid slippage. Adjustment inferiorly is achieved by moving the lower perimeter of the apparatus from the area behind and beneath user's chin, at points along the jaw line submandibularly and reaching user's neck.

in use, the user fits the apparatus to user's face via one of 2 methods. One method is achieved by orienting the apparatus with spring-loaded, push-button cylinder lock 4 at a position upward aligned with user's head apex and mesh panel 2 over user's mouth, placing the inferior portion of the apparatus under and past the chin and toward user's neck, pulling each side on both sides of user's face and then drawing the spring-loaded, push-button cylinder lock 4 toward user's head's apex either at user's hairline or beyond users hairline, on user's hair, and toward user's head's apex whereby said spring-loaded, push-button cylinder lock 4 may be adjusted to desired tightness about user's face. Another method is achieved wherein the apparatus, with spring-loaded, push-button cylinder lock 4 at a position upward aligned with user's head apex and mesh is aligned with user's mouth, is placed at user's hairline or beyond user's hairline, and on user's hair, and the inferior portion of apparatus is then drawn under and past the chin and toward user's neck. In each method, 1 and 2, adjustments are made, superiorly, inferiorly and on each side, by adjusting said drawstring 5 tautness via said spring-loaded, push-button cylinder lock 4 or physical manipulation of said apparatus' upper, lower and side edges about user's face to ensure a tight seal and individualize conformity.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

I claim:

1. An apparatus for preserving a user's facial makeup during bathing and dressing comprising:

a concave waterproof shell configured to adapt and adhere to a shape of a user's frontal portion of user's face;

a drawstring;

said drawstring located about a perimeter of said concave waterproof shell; and a drawstring lock;

wherein said drawstring lock is configured to adjust a tension of said drawstring to create a seal around said user's face and prevent dislocation:

said drawstring lock adapted to reside superiorly aligned with an apex of a user's head for securing and adjustment.

2. The apparatus for preserving the user's facial makeup bathing and dressing of claim 1, wherein the concave waterproof shell comprises:

a breathable mesh panel allowing configured to allow said user to breathe;

said breathable mesh panel adapted to correspond to a location of a nose and mouth of said user;

said breathable mesh panel existing on a lower third of said concave waterproof shell on an end opposite said drawstring lock.

3. The apparatus for preserving the user's facial makeup bathing and dressing of claim 2, wherein said concave waterproof shell's mesh panel is a net-like material configured for allowing air to pass across said mesh panel portion of panel's surface.

4. The apparatus for preserving the user's facial makeup bathing and dressing of claim 3, wherein said concave waterproof shell's net-like material is metal, plastic, polyester, or silk.

5. The apparatus for preserving the user's facial makeup during bathing and dressing of claim 1, where said concave waterproof shell is made of a lightweight, translucent waterproof material.

6. The apparatus for preserving the user's facial makeup during bathing and dressing of claim 1, wherein said drawstring is made of a flexible, strand material.

7. The apparatus for preserving the user's facial makeup during bathing and dressing of claim 6, wherein said drawstring is nylon or rubber.

8. The apparatus for preserving the user's facial makeup during bathing and dressing of claim 1, wherein said drawstring lock is a spring-loaded, push-button cylinder lock, hook and loop type fasteners, or wire crimps.

9. A method of fitting a waterproof apparatus shell, defined as having a concave shell for receiving a user's face, wherein said waterproof apparatus shell is encircled by a drawstring about its perimeter that is adjustable superiorly via a spring-loaded, push-button cylinder lock and exhibiting a breathable mesh panel corresponding to a user's mouth, whereby said waterproof apparatus shell is placed onto said user's face by:

aligning said waterproof apparatus shell where said spring-loaded, push-button cylinder lock is configured to be oriented superiorly and toward an apex of a user's head and said breathable mesh panel is configured to be oriented over said user's mouth;

first, placing a lower portion of said waterproof apparatus shell under and past a user's chin and toward a user's neck;

second, placing an upper portion of said waterproof apparatus shell on a user's forehead;

adjusting the tightness of said drawstring through tightening and loosening of said spring-loaded, push-button cylinder lock; and adjusting said waterproof apparatus shell perimeter superiorly, inferiorly and on each side to conform to said user's face.

10. The method of claim 9 wherein said upper portion of said waterproof apparatus shell is placed past said user's forehead and hairline and onto a user's hair.

11. The method of claim 9 wherein said upper portion of said waterproof apparatus shell is placed first and said lower portion is placed second.

12. The method of claim 11 wherein said apparatus is placed past said user's forehead and hairline and onto a user's hair.

* * * * *